United States Patent [19]

Trampe

[11] 4,228,626

[45] Oct. 21, 1980

[54] PREFABRICATED PANEL MODULE CONSTRUCTION

[76] Inventor: Stanley F. Trampe, 920 Greeley Ave., Webster Groves, Mo. 63119

[21] Appl. No.: 864,493

[22] Filed: Dec. 27, 1977

[51] Int. Cl.[2] ..... E04B 1/00; E04C 1/30

[52] U.S. Cl. ..... 52/275; 52/582

[58] Field of Search ..... 52/582, 589, 592, 578, 52/595, 785, 593, 275

[56] References Cited

U.S. PATENT DOCUMENTS

| | | | |
|---|---|---|---|
| 1,959,176 | 5/1934 | Rau | 52/582 X |
| 2,140,772 | 12/1938 | Slayter et al. | 52/582 X |
| 2,321,567 | 6/1943 | Wilson | 52/582 X |
| 2,349,684 | 5/1944 | Stannard et al. | 52/582 |
| 2,621,378 | 12/1952 | Wilson | 52/582 |
| 2,630,604 | 3/1953 | Marsh | 52/592 X |
| 2,825,098 | 3/1958 | Hultquist | 52/582 X |
| 2,849,758 | 9/1958 | Plumley et al. | 52/589 X |
| 3,665,662 | 5/1972 | Timbrook et al. | 52/592 X |
| 4,011,701 | 3/1977 | Turkia | 52/593 X |

FOREIGN PATENT DOCUMENTS

| | | | |
|---|---|---|---|
| 949524 | 9/1956 | Fed. Rep. of Germany | 52/785 |

*Primary Examiner*—J. Karl Bell

*Attorney, Agent, or Firm*—Charles B. Haverstock

[57] ABSTRACT

A Prefabricated Panel Module Construction for use in constructing walls and enclosures comprising a substantially rectangular frame assembly with a substantially flat rectangular sheet of sheathing material attached thereto. The frame assembly includes four side framing portions preferably of substantially uniform cross-section dimensions. The sheathing material has side edges defining a substantially rectangular shape and is attached to the framing portions of the frame assembly such that each of the framing portions is associated with a respective side edge of the sheathing material and such that the sheathing material projects beyond at least three sides of the frame assembly to form overhangs thereat and extends along the remaining fourth side framing portion of the frame assembly to at least partially overlap the framing portion along its length. In a preferred embodiment the framing portion along the fourth side of the frame assembly projects beyond the associated edge of the sheathing material to form an underhanging thereat, which underhanging is less than the width of the framing portion. The overhang oppositely disposed from the underhanging projects beyond the frame assembly a distance less than or equal to the width of the underhanging and the width of the overhangs at the other sides of the frame assembly are preferably less than the depth of the framing portions. In an alternate embodiment the sheathing material projects beyond the frame assembly along the fourth side thereof to also form an overhang thereat, and the widths of all the overhangs are preferably less than the smaller of the width or depth of the framing portions. In both embodiments the sheathing material is preferably lightproof and the framing portions may include predrilled holes and channels therein to allow a plurality of like panel modules to be easily assembled to form walls or enclosures and to be joined to one another by conventional fasteners, such as nuts and bolts or screws. A plurality of such modules may be provided in kit form and assembled to form a complete and essentially lightproof and dustproof room enclosure. The subject device also lends itself to ease of disassembly for storage and transport.

34 Claims, 21 Drawing Figures

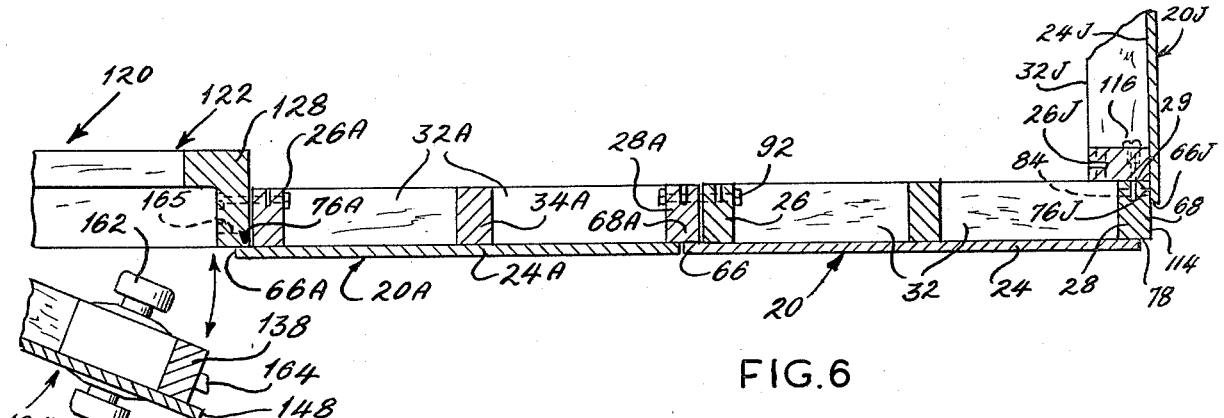
FIG.6
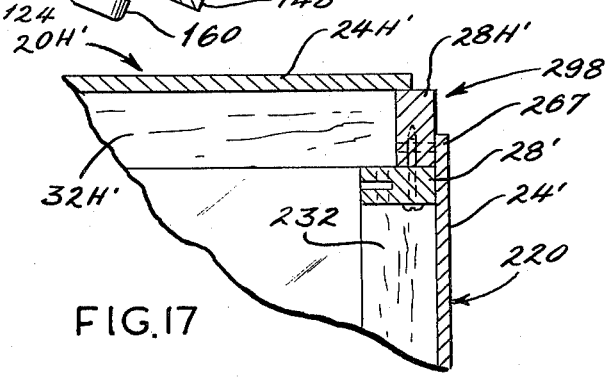
FIG.17
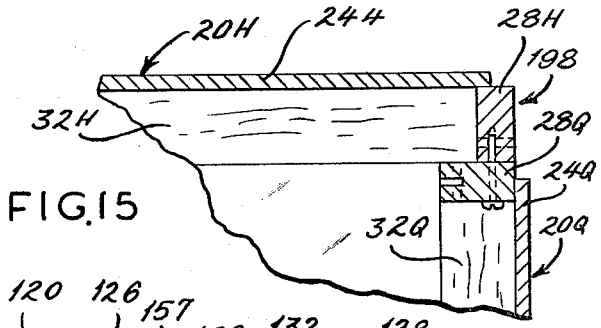
FIG.15
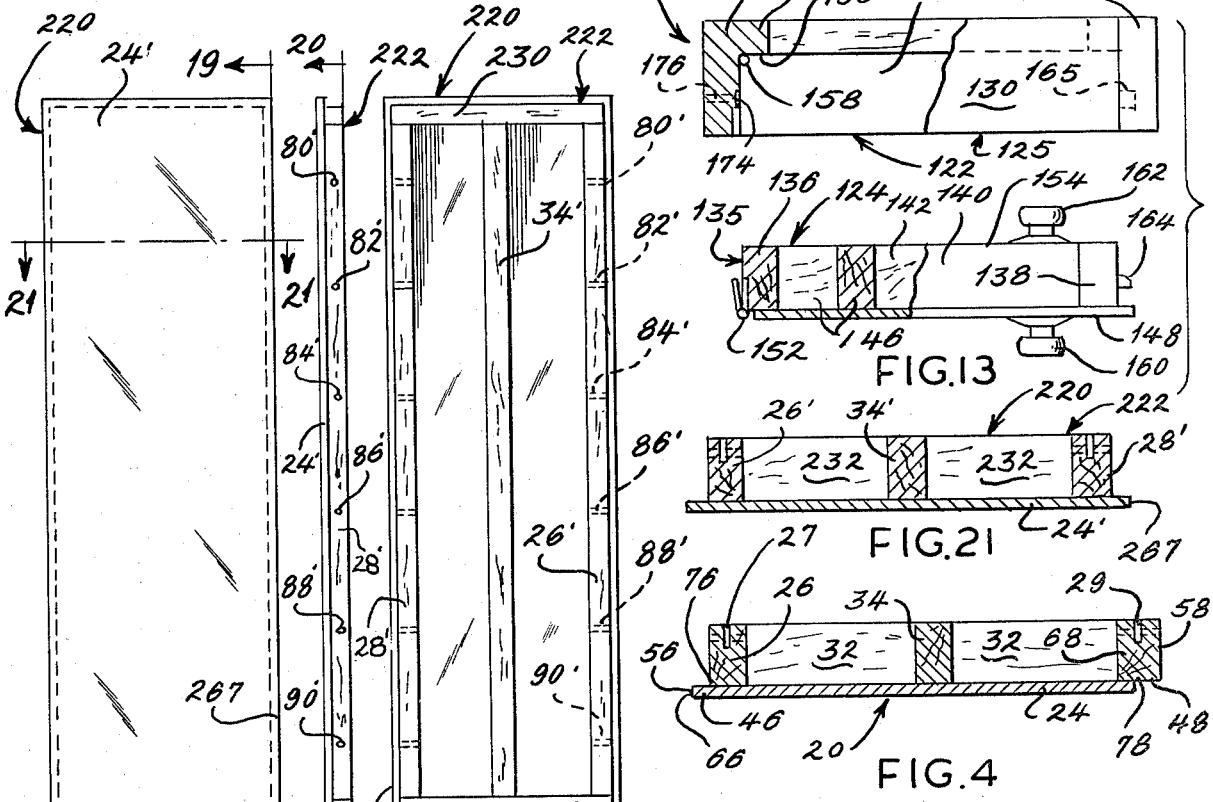
FIG.18 FIG.19 FIG.20
FIG.13
FIG.21
FIG.4

PREFABRICATED PANEL MODULE CONSTRUCTION

This invention relates to a prefabricated panel module construction that may be employed to construct walls, enclosures, and structures and that is adapted to be provided in a kit form that can be assembled both quickly and easily.

A variety of devices and systems for constructing walls and enclosures of various types have been proposed and utilized in the past. Many of these have involved attempts to develop prefabricated components in hopes of reducing construction costs and to provide for ease of construction. One example of the type of component devices that have been utilized in the past is disclosed in U.S. Pat. No. 3,603,060. However, such components are not only of small size, which means that a very large number are required in order to erect a wall or other structure, requiring considerable labor time and expense, but they also require the use of numerous other and additional structural components therewith to construct any type of wall or structure. Other patents, such as U.S. Pat. Nos. 1,649,872; 2,307,787; 3,774,362; 3,813,832; and 3,972,167, disclose the use of various other types of construction components that may be employed in construction projects, but many of these also require the use of additional structural components, especially at corners, in order to assemble completed structures. Additionally, many of these components are framing components only and have no paneling mounted thereon. These framing components require that any desired paneling must be attached thereto after or during the erection of a frame wall or structure, and, consequently, are not prefabricated paneled components, as are the panel modules of the subject invention. In a few instances components have been disclosed wherein paneling has been mounted on a frame assembly to form prefabricated frame and panel components, but such prefabricated components have not generally been adapted to be used with other like components to form walls and enclosures in the absence of additional structural members or without requiring the cutting of some of the components at the construction site so as to permit proper assembly. Moreover, such prefabricated components have not been designed or constructed in any manner similar to that of the present invention so as to minimize light or dust leakage at joints between two like components, regardless of the configuration of the two components with respect to one another. In fact, none of the component devices of the referenced patents, nor any other known components, are prefabricated modules which include both a frame assembly and mounted paneling and which are adapted in any manner like the panel modules that are the subject of the present invention to be quickly and easily attached to one another by conventional fastening means to form walls, corners, and complete ceilinged interior enclosures that are essentially lightproof and dustproof. Furthermore, known construction systems that make use of prefabricated construction components for the most part employ components that are specially tailored to specific building plans and are designed for use by a builder or contractor, and such components are not generally available and/or suitable, as are the panel modules of the present invention, especially to the lay individual who wishes to remodel or upgrade his present home and who wishes to do so on a do-it-yourself basis.

The present invention overcomes these and other disadvantages and, at the same time, because of the novel construction of the individual modules that are the subject of the present invention, which construction permits overlapping joinder between adjacent panel modules, also minimizes light and dust leakage that can occur through the joints between joined panel modules. The overlapping joinder that is possible along all sides of panel modules constructed according to the present invention is an important feature of the prefabricated modules and permits a plurality of individual panel modules constructed according to the present invention to be assembled to form walls, structures, and complete ceilinged enclosures that can be quickly and easily erected by a single individual using only simple hand tools, such as a screwdriver and wrench or nutdriver. Consequently, a homeowner can use such panel modules to construct a utility or like room in his basement, and, because of the design of the modules and the ease with which the structure can be assembled, can also easily dismantle the structure and move it elsewhere for re-erection if he sells his home or otherwise desires to relocate the structure. The design of the modules also permits an individual to assemble the modules to form an essentially lightproof and dustproof freestanding interior structure, such as a photographic darkroom or the like, and to do so at less cost than building a more conventional darkroom.

Moreover, such enclosures can be constructed from modules all of which, or nearly all of which, are substantially identical. The substantial identity of the modules permits easier and more economical manufacture of the panel modules since one manufacturing jig setup can be employed for constructing all, or nearly all, of the modules required for a given enclosure. In some instances, as for instance, when a photographic darkroom is to be erected and lightproofing of the enclosure is highly important, it may be necessary to utilize a minimal number of non-standardized modules to eliminate or minimize light leakage to the greatest extent possible, but even in these instances only a very limited number of non-standardized modules will be required and the jig setup for manufacture need not be radically different for these non-standardized modules. The fact that all, or nearly all, of the modules will be substantially identical, and that, even for any non-standardized modules, the module dimensions will not vary greatly from standard, offers the additional advantage that a plurality of panel modules can be easily packaged in a kit form, as for instance, in a box-like rectangular package, that can be conveniently moved or stored. Such advantage is desirable not only because of the economies realized by the manufacturer in storing and shipping kits that may be assembled into freestanding enclosures, but also because of the ease of marketing and the convenience realized by the consumer in being able to obtain, in a single package, all that he requires to assemble a complete, semi-permanent freestanding enclosure within his home, office, or other desired location. Furthermore, should the consumer ever wish to disassemble the enclosure, he can do so quickly and easily and can easily re-package the kit for storage or shipment to another location.

It is therefore a principal object of the present invention to provide a prefabricated panel module construction that can be joined with other similar panel module constructions in an overlapping manner for use in constructing walls and enclosures.

It is a further object of the present invention to minimize light and dust leakage at joints between prefabricated panel modules.

Another object is to provide panel module constructions that may be easily and quickly joined together and assembled even by a single individual to form walls or freestanding enclosures.

A still further object is to provide panel module constructions that may be assembled with only simple hand tools to form walls or enclosures.

Another object of the present invention is to minimize the number of different structural components required to assemble a freestanding enclosure.

Another important object is to provide a prefabricated panel module construction that may be joined to a like module in a transverse relationship without any requirement for an additional special structural corner member or the necessity of cutting or otherwise modifying either of the joined modules.

Still another object of the present invention is to provide a prefabricated panel module construction that may be included with other like modules in kit form for building a utility room or other like enclosure.

A further object is to provide an assembly kit of prefabricated panel module constructions for erecting a freestanding ceilinged enclosure that may be quickly and easily assembled and disassembled.

A still further object of the present invention is to provide a kit that may be assembled by a single individual to form an essentially lightproof and dustproof freestanding enclosure.

Another important object is to provide prefabricated panel module constructions which may be easily joined together to form walls and enclosures that can thereafter be easily dismantled for movement to another location.

These and other objects and advantages of the present invention will become apparent after considering the following specification which covers preferred embodiments of the subject device in conjunction with the accompanying drawings, wherein:

FIG. 4 is a sectional view taken on line 4—4 of FIG. 1.

FIG. 6 is a fragmentary sectional view taken on line 6—6 of FIG. 5.

FIG. 13 is an exploded top view, partly in section, of the module depicted in FIG. 10, taken on line 13—13 of FIG. 10.

FIG. 15 is a fragmentary cross-sectional view of a corner of the enclosure of FIG. 5, taken on line 15—15.

FIG. 17 is a fragmentary cross-sectional view, similar to FIG. 15, of a corner of the enclosure of FIG. 16.

FIG. 18 is a front elevational view of another panel module embodiment constructed according to the present invention.

FIG. 19 is a side elevational view of the panel module of FIG. 18, taken on line 19—19.

FIG. 20 is a rear elevational view of the panel module of FIG. 18, taken on line 20—20 of FIG. 19.

FIG. 21 is a cross-sectional view taken on line 21—21 of FIG. 18.

Figures 1, 2, 3, 5, 7, 8:
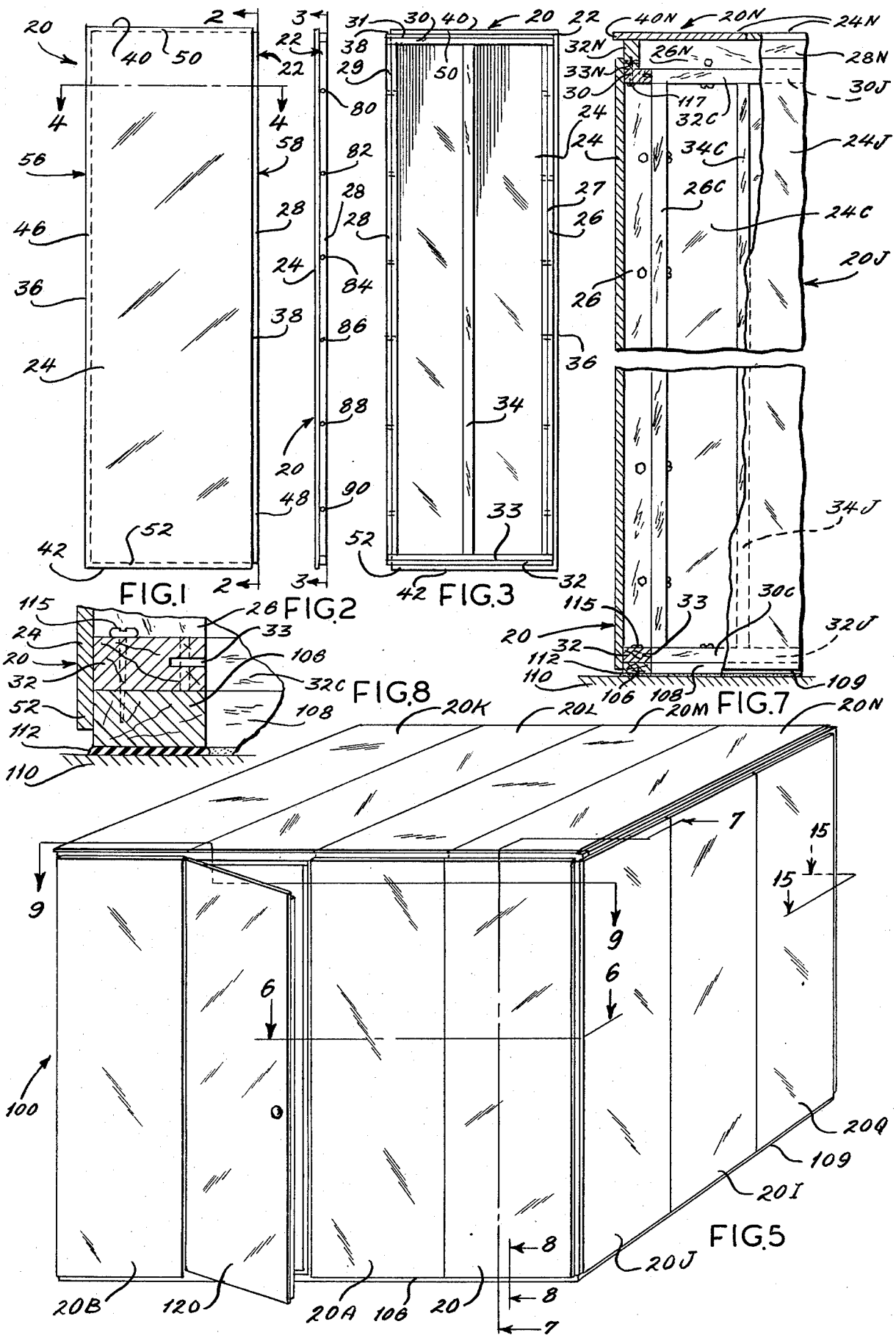
FIG. 1 is a front elevational view of a preferred embodiment of a panel module constructed according to the present invention.
FIG. 2 is a side elevational view of the construction of FIG. 1 taken on line 2—2.
FIG. 3 is a rear elevational view of the panel module of FIG. 1 taken on line 3—3 of FIG. 2.
FIG. 5 is a perspective view of a freestanding enclosure employing a plurality of panel modules of the type depicted in FIG. 1.
FIG. 7 is a fragmentary sectional view taken on line 7—7 of FIG. 5.
FIG. 8 is a fragmentary sectional view taken at floor level on line 8—8 of FIG. 5.

Referring to the drawings more particularly by reference numbers, wherein like numbers refer to like items, number 20 in FIGS. 1–3 refers to a preferred embodiment of a prefabricated panel module having a rectangular frame assembly 22 with a sheet of rectangular sheathing material 24 attached thereto. The rectangular frame assembly includes two longer side framing portions 26 and 28 and two shorter framing portions 30 and 32. A cross brace member 34 is attached to and extends between the midpoints of the two shorter side framing portions 30 and 32 to further strengthen the assembly 22. The framing portions 26, 28, 30 and 32 are preferably chosen, as illustrated in the accompanying drawings, to have a uniform rectangular cross-section, although such uniformity is not necessarily required. Such uniformity, however, simplifies fabrication of a module, reduces the cost thereof, and therefore is highly desirable. Framing portions might typically be constructed of ordinary construction lumber, such as 1″×2″ lumber, or from pieces of particle board cut to appropriate size and formed into a rectangular frame, but any material suitable for being formed into a frame assembly may be employed. Each of the framing portions 26, 28, 30, and 32 preferably has a narrow channel or rabbet on its reverse side, such as rabbets 27, 29, 31, and 33 respectively, as best shown in FIGS. 4, 7, and 8, which rabbets aid in assembling a plurality of panel modules into a freestanding enclosure, as will be more fully explained hereinafter.

The sheathing material 24 is rectangular in shape and has side edges 36, 38, 40 and 42 associated respectively with the framing portions 26, 28, 30 and 32 of frame assembly 22. The sheathing material 24 may be of any suitable material, such as tempered masonite, plywood, or laminated paper board, but is generally selected to be lightproof and to be easily attached to the frame assembly 22. Attachment may be effected by any means acceptable to maintain joinder of the sheathing material 24 to the frame assembly 22 during normal use. For example, joinder may be effected by nailing, stapling or screwing tempered masonite to a frame assembly of 1"×2" lumber or by gluing laminated paper board to a frame constructed of dense particle board. The sheathing material 24 is attached to the frame assembly 22 such that side edges 36, 40, and 42 project beyond their associated framing portions 26, 30, and 32 to form overhangs 46, 50 and 52 respectively. Framing portion 28 is partially overlapped along its entire length by sheathing material 24 but projects beyond the side edge 38 of the sheathing material 24 to form an underhanging 48 thereat.

As is best shown in FIG. 4, the module 20 thus is constructed to have reciprocally rabbetted side edge portions 56 and 58 associated respectively with overhang 46 and with underhanging 48, whereby the side edge portion 56 has a one-sided tenon 66 with a reverse rabbet 76 and the side edge portion 58 has a one-sided tenon 68 with an obverse rabbet 78. One-sided tenons with reverse rabbets, similar to tenon 66 and rabbet 76, are also formed by framing portions 30 and 32 and their associated respective overhangs 50 and 52.

The width of the underhanging 48 is preferably selected to be less than the width of the framing portions 26, 28, 30 and 32, and the overhang 46, which is oppositely disposed from the underhanging 48, is preferably selected to have a width less than the width of the underhanging 48. The widths of the overhangs 50 and 52 are preferably selected to be less than the depth of the framing portion 26, 28, 30, and 32, and in the module 20 are selected to be the same as the width of the overhang 46.

With such selection of overhang and underhanging widths, a plurality of substantially identical panel modules 20–20Q may be placed in abutment with and joined to one another to form an enclosure suitable for use as a basement utility room or the like, such as enclosure 100 shown in FIG. 5. FIG. 6 indicates the manner in which panel modules 20 and 20A may be placed in side-by-side abutment such that one-sided tenon 66 of module 20 and one-sided tenon 68A of panel module 20A form a scarf-joint between the two panel modules 20 and 20A. The modules may be secured to one another by attaching framing portion 26 of module 20 to framing portion 28A of module 20A by any conventional fastening means. One such way in which this might be accomplished is to include a plurality of predrilled holes in the framing portions 26 and 28, such as holes 80-90 in framing portion 28, which holes are most clearly depicted in FIG. 2, through which may be inserted a nut and bolt combination, such as the combination 92 depicted in FIG. 6, to join and hold the modules 20 and 20A in side-by-side abutment.

Because of the novel construction of the panel modules 20–20Q, they can be not only joined to one another in side-by-side relationship but can also be joined to one another in transverse side-to-side relationship while still maintaining the overlap condition between the two joined modules. As is illustrated in FIG. 6, panel modules 20 and 20J may be placed in side-to-side transverse relationship with one another such that the one-sided tenon 68 of module 20 is positioned in rabbet 76J of panel module 20J with one-sided tenon 66J of module 20J overlapping the side surface portion 114 of tenon 68 of module 20. The panel modules 20 and 20J may be attached to one another by an conventional fastening means, such as by common wood screws like wood screw 116. A pilot hole is preferably predrilled in framing portion 26J extending part way therethrough and being in alignment with the rabbet 29 along the rear side of framing portion 28 of module 20 when the modules 20 and 20J are positioned in a transverse side-to-side relationship. The pilot hole and rabbet aid in starting the screw 116 and in properly positioning the modules 20 and 20J with respect to one another so as effect proper joinder therebetween while maintaining the overlap. The sheathing material 24J of module 20J preferably partly overlaps side surface portion 114 of tenon 68 of module 20 sufficiently to cover any predrilled holes in the framing portion 28, such as hole 84, so as to maintain essentially lightproof and dustproof joints between the modules.

Similar type overlapping is achieved in end-to-end and in end-to-side transverse relationships, as can be best observed in FIG. 7. Panel modules 20 and 20N may be placed in an end-to-end transverse relationship with the sheathing material 24 of panel module 20 overlapping the side surface of frame member 32N of panel module 20N to form an essentially lightproof and dustproof joint therebetween. Similarly to the joinder of panel modules 20 and 20J, as depicted in FIG. 6, the frame member 30 of module 20 is joined to frame member 32N of panel module 20N by conventional wood screws, such as by wood screw 117.

FIG. 7 also illustrates panel modules 20N and 20J in an end-to-side transverse relationship such that sheathing material 24J of panel module 20J overlaps the side surface of framing portion 28N of panel module 20N to form an essentially lightproof and dustproof seal therebetween. It may thus be observed that two like panel modules of the type described may be easily joined to one another in such a way that overlapping will occur at all joints formed between the modules. Moreover, the modules may be joined to one another in transverse relationships without any requirement that there be additional structure such as corner posts or ceiling beams. As a consequence, a plurality of modules of the type described can be readily employed to construct walls and enclosures, including enclosures of the type depicted in FIG. 5.

When constructing any wall segment, however, it is generally necessary to employ base members upon which the wall segment is mounted and to which the wall segment is attached. This is generally necessary because of the overhang 52 of the module 20. FIGS. 7 and 8 best illustrate the use of base members, such as base members 106, 108, and 109, in constructing a wall segment. As may be observed in FIG. 7, the modules rest upon the base members such as members 106, 108, and 109 and may be attached thereto by any common fastening means, such as by the use of wood screws, as is more clearly shown in FIG. 8. The size of the base members may be varied somewhat to increase or decrease the overall height of a wall or an enclosure such as enclosure 100, and the base members, which may be, for instance, 1" by 2" lumber, can be shaped or otherwise made to conform with irregularities of a floor or other like surface 110 upon which a wall segment is to be constructed. Conformable material 112, such as rubber or felt padding or the like, may be attached to the bottom of the base members 106, 108, and 109 to help achieve conformity with the floor surface 110 and the conformable nature of the material will also act to form a pliable seal which minimizes light and dust leakage at the base of a wall or enclosure, as can be observed in FIG. 8. When the module 20 is mounted on top of base member 106 the framing portion 32 abuts the base member 106 and the overhang 52 overlaps a side surface of the member 106 to form an essentially lightproof and dustproof joint between the module 20 and the base member 106. Wood screw 115 and other like screws are employed to attach module 20 to member 106. It may be desired, prior to constructing a wall segment or enclosure, to attach the base members to the floor 110 or other surface to stabilize and strengthen the wall or enclosure, but such action is not always required, especially when the structure is to be a complete enclosure such as enclosure 100. The base members may simply be positioned on the floor and the panel modules mounted thereon and assembled to form a freestanding ceilinged enclosure. In such event, the strength of the assembled structure itself will obviate the need for attaching the base members to the floor for stability and wall strength.

It should be recognized that as individual modules are joined to one another to form wall segments, the segments, like individual modules, will have an underhanging along one side and overhangs at the other three sides. If it is desired to erect a wall segment between two existing walls and an existing floor and ceiling, frame members may be utilized along those sides of the wall segment that have overhangs in a manner similar to that already described with respect to base members. The size of such frame members may vary depending upon the amount of space between the edges of the frame assemblies in the wall segment and the walls, ceiling, and floor. Like the members 106-109, frame members at the sides or top of a wall segment may include sealing means such as rubber padding 112 for effecting a lightproof and dustproof seal between the frame members and the walls and ceilings, and these members may also be attached to the existing walls and ceiling if so desired or if required to provide adequate stability and strength to the erected wall segment. In some instances, such as when a wall segment is to be erected in a basement, it may be possible to position the wall segment such that the overhang at the top thereof will overlap a rafter, and thus an essentially lightproof and dustproof joint can be effected at the top of the wall segment without the necessity of employing any frame members at the ceiling. With this in mind, it should also be recognized that the height of a wall segment can be varied slightly depending upon the size of the base members utilized and that, for a particular sized panel module, utilization of an appropriately sized base member may thus obviate the need for any ceiling frame member.

While it is thus apparent that a plurality of standarized modules may be employed to construct wall segments, it should also be recognized that if it becomes necessary to have an opening through a wall segment constructed from such modules, some sort of door module must be provided. A typical door module 120, such as shown in FIGS. 10–13, may include a shell portion 122 and a door portion 124. The shell portion 122 includes a rectangular frame assembly 125 having four side framing portions 126, 128, 130, and 132, preferably of generally L-shaped cross section. The width and height of the frame assembly 125 are preferably selected to be the same as the width and height of frame assembly 22 of panel module 20.

Figures 9, 10, 11, 12, 14, 16:
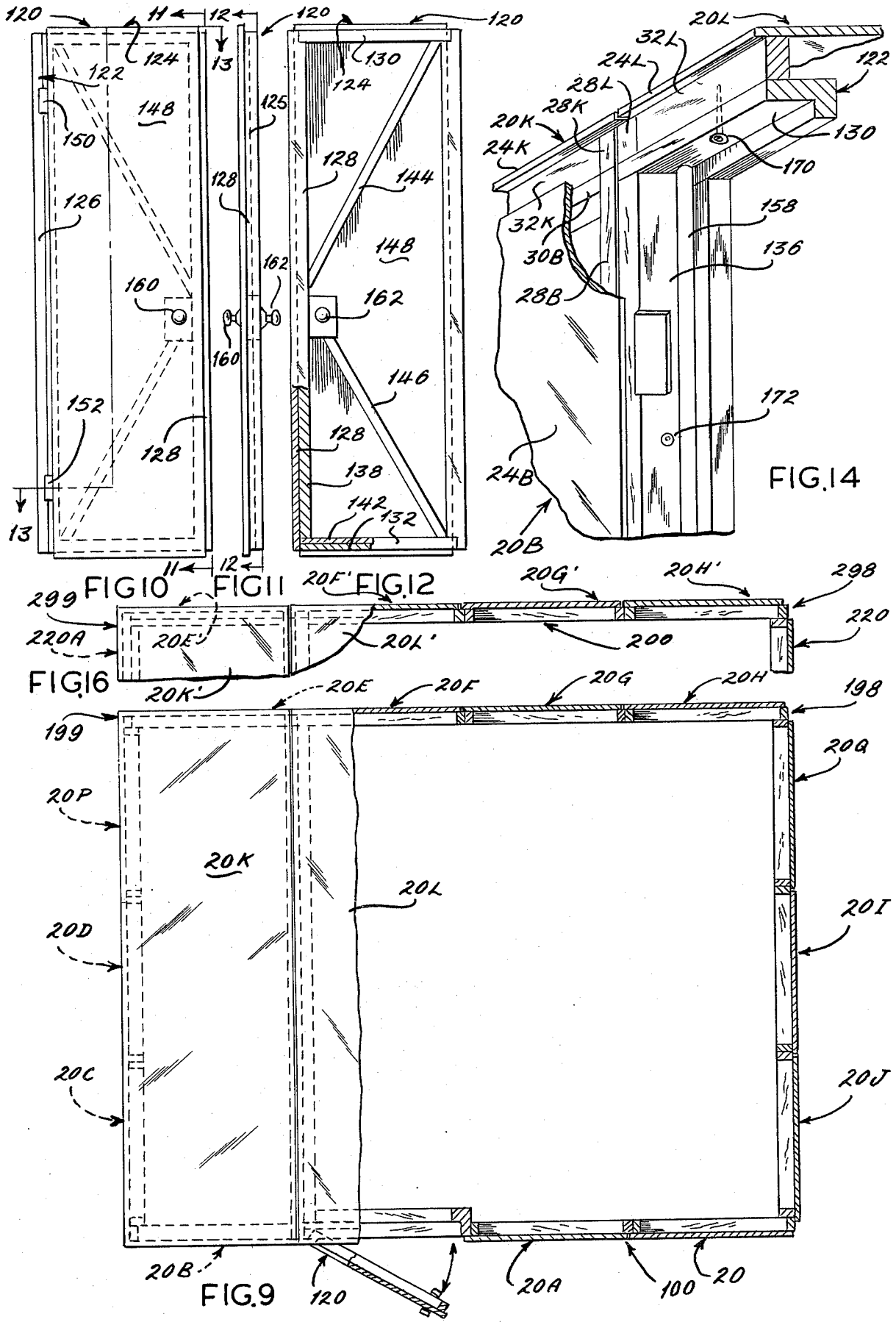
FIG. 9 is a top view, partly in section, of the enclosure of FIG. 5, taken on line 9—9.
FIG. 10 is a front elevational view of a preferred embodiment of a door panel module constructed according to the present invention and employed in the enclosure of FIG. 5.
FIG. 11 is a side elevational view of the module depicted in FIG. 10 taken on line 11—11.
FIG. 12 is a rear elevational view of the panel module depicted in FIG. 10, taken on line 12—12 of FIG. 11.
FIG. 14 is a fragmentary perspective view, partly in section and partly in breakaway, showing joinder of a corner of the door module in the enclosure of FIG. 5 to wall and ceiling modules.
FIG. 16 is a fragmentary cross-sectional view, similar to FIG. 9, of another enclosure embodiment similar to the enclosure of FIG. 5.

Door portion 124 of module 120 has a rectangular frame assembly 135 including framing portions 136, 138, 140, and 142. Diagonal bracing members 144 and 146, as best illustrated in FIG. 12, may optionally be employed to strengthen the frame assembly 135. A rectangular sheet of sheathing material 148, similar to sheathing material 124 of panel module 20, is attached to the frame assembly 135 such that the framing portion 136 and the sheathing material 148 of panel module 120 define an underhanging along one side of door portion 124 and such that the sheathing material 148 overhangs the remaining framing portions 138, 140 and 142 of frame assembly 135.

The door portion 124 is attached to shell portion 122 of door module 120 by means of hinge assemblies 150 and 152. When the door portion 124 is thus joined to the shell portion 122 and the door is closed the reverse side 154 of frame assembly 135 abuts the front sides of the leg extensions of the L-shaped frame members of the shell portion frame assembly 125, such as front side 156 of leg extension 157 of frame member 126. At the same time, the sheathing material 148 of the door portion 124 overlaps framing portions 128, 130 and 132 of the shell portion 122. Such construction helps ensure that when the door 124 is closed the module 120 will be essentially lightproof and dustproof. A rubber or like sealing strip 158 may be mounted along the interior edge of the L-shaped framing portion 126 of shell portion 122, as is best shown in FIG. 14, to further ensure the module will be light and dustproof. Such a strip is desirable in this location since there is no overlap between the sheathing material 148 of door portion 124 and framing portion 126 of shell portion 122. Because of the overlap occurring between sheathing material 148 of door portion 124 and framing portions 128, 130 and 132, however, such a sealing strip is not as necessary or desirable along the interiors of the elbows of the L-shaped framing portions, although it may also be employed thereat, if desired.

Various hardware items, including items such as door knobs 160 and 162 and a door latch assembly with a plunger 164 operatively connected to the door knobs 160 and 162 and adapted to enter recess 165 in framing portion 128 of the shell portion 122 may be also mounted on the door module. It will be recognized that numerous methods and hardware items for effecting door opening, closing, and latching may be employed and that the hardware items shown are illustrative only and are not per se part of the invention. The same is true of the hinge assemblies 150 and 152, discussed previously.

As illustrated in FIG. 14, door module 120 may be attached to panel modules of the type previously described in much the same way that those modules are attached to one another. For example, shell portion 122 of module 120 is shown attached to module 20L by means of a wood screw 170 (FIG. 14). Preferably, the screw is countersunk and its head is recessed into framing portion 130 of shell portion 122 so as not to interfere with closure of door portion 124 of the module. The shell portion 122 is joined to module 20B by means of bolts and T-nuts, such as T-nut 172. As can be observed from FIG. 13, a bolt may be easily inserted into hole 176 in framing portion 126 of shell portion 122 to engage T-nut 174 which extends into the hole 176. The use of T-nuts obviates the need for any protrusions along portion 126 which could interfere with closing the door portion 124.

It will be recognized that a plurality of likesized modules, such as module 20, may be employed with a door module, such as module 120, to erect walls and various opentopped enclosures that have an entry and exit means. Such enclosures may be erected having an overlap at each joint between the modules employed. In many instances such a construction may be useful and desirable and often may be all that is required by a particular user, especially if a ceiling is not necessary or, in the event that a ceiling is necessary or desired, if some existing structure is conveniently located to serve as a ceiling for the enclosure. For instance, for properly dimensioned modules the ceiling in a basement might also be suitable to serve as a ceiling for the enclosure and lightproof and dustproof joints may be realized between the existing ceiling and the modules as has already been previously described.

However, in other instances it may be necessary or desirable that some sort of ceiling be provided and there may be no suitable or convenient structure that can appropriately be used as a ceiling for the enclosure. Such a situation might arise if an individual wishes to construct a photographic darkroom or the like in his basement and wishes to be able to do so by means of a structure that can be easily erected, dismantled, moved, and again reassembled at a different location. In an increasingly mobile society such a construction is advantageous since it allows the user to pattern the basement of his residence to suit his needs without requiring permanent modifications to the residence. Because the subject structures are not necessarily permanent, the user can conveniently take them with him if he moves and this also allows a new resident to thereafter utilize the space formerly occupied by the darkroom structure according to his own needs and desires.

If a user wishes to construct a utility or like room with a ceiling, and lightproofing and dustproofing are not critical considerations, a plurality of like-sized modules, such as panel modules 20–20Q, and a similarly sized door module 120 can be employed to construct the walls for an enclosure, such as for the 4×3 module structure 100 depicted in FIGS. 5 and 9. With such a construction, however, there is not a complete overlap at the two rear corners 198 and 199 of the structure 100, as is best shown in FIGS. 9 and 15, and the possibility of light or dust leakage thereat is greater than if there was an overlap.

If, on the other hand, lightproofing or dustproofing is important to the user, as, for instance, for a photographic darkroom, he may wish to take appropriate steps to eliminate or minimize, to the extent possible, any light or dust leakage at all the corners of the structure. One manner in which this might be done would be to apply a lightproofing material at the interface between the modules which are joined together at the non-overlap corners. This could even take the form of employing a conformable material similar to rubber padding 112 between framing portions 28Q and 28H in FIG. 15. For a variety of reasons, however, it is often more desirable to be able to construct a structure in which there is overlap at all corners and between all modules employed in the structure, whereby light and dust leakage can be minimized with no necessity for inserting additional materials or structure between the modules. One way in which this can be accomplished is by employing two modules of an alternative embodiment with overhangs on all four sides, such as the module 220 of FIGS. 18–21, in place of the modules 20P and 20Q of FIG. 9. A module of this type could be constructed by using a sheet of sheathing material slightly wider than the sheathing material 24 used for panel module 20 and positioning it on frame assembly 22 such that the sheathing material projects beyond and overlaps all four sides of the frame assembly. If this were done, however, a manufacturer would probably have to either stock two different sizes of sheathing material or otherwise stock only the larger sized sheets of sheathing material but trim down the sheathing for construction of modules such as module 20. Both of these options are somewhat undesirable since they would cause significantly increased expense to the manufacturer.

Another, and more suitable, way in which such a module can be constructed is to use a common sized sheet of sheathing material for both module 20 and module 220 but to make the width of the frame assembly of module 220 slightly less than the width of the frame assembly 22 of the module 20. FIGS. 18–21 illustrate a panel module 220 constructed in this manner. The module 220 includes a frame assembly 222 having framing portions 26', 28', 230, and 232. The portions 26' and 28' are substantially identical to portions 26 and 28 of module 20. The framing portions 230 and 232 are slightly shorter than the corresponding portions 30 and 32 of module 20. A cross brace member 34', substantially identical to member 34 of module 24, extends between the midpoints of portions 230 and 232 to provide additional panel support. A sheet of sheathing material 24', substantially identical to sheathing material 24, is attached to the frame assembly such that it overhangs each of the four framing portions 26', 28', 230 and 232. This results in an additional overhang 267 on module 220 associated with framing portion 28'.

Two modules of this type, such as modules 220 and 220A in FIG. 16, may be employed with a plurality of like-sized modules of the same type as module 20 and with a door module of the same type as module 120 to construct the walls of a structure, such as structure 200 of FIG. 16, which is similar to structure 100 in FIG. 9. The resulting structure 200 is nearly identical to structure 100, but, unlike structure 100, has overlaps at the two rear corners 298 and 299 of the structure 200, as is illustrated in FIG. 16, which overlaps are achieved primarily because of the use of modules 220 and 220A in place of modules 20Q and 20P respectively. These overlaps act to reduce light and dust leakage at the joints between modules 220 and 20H' and between modules 220A and 20E'. This is more fully illustrated in FIG. 17 wherein it can be seen that additional overhang 267 of module 220 overlaps the side surface of framing portion 28H' of panel module 20H' at corner 298. In this manner it is thus possible to construct the walls of an enclosure such that light and dust leakage at joints between the modules employed is eliminated or minimized.

As can be observed from FIGS. 5, 7, 9, 14 and 16, the frame assemblies of the ceiling modules in structures 100 and 200 rest on top of the frame assemblies of the wall modules in end-to-end and end-to-side transverse relationships and the lengths of the frame assemblies of the ceiling modules are such that the side surfaces of the framing portions abut the back sides of the sheathing material of the wall modules, as is shown in FIG. 7 and as has already been described. While the lengths of the frame assemblies of the ceiling modules need not necessarily be the same as the heights of the frame assemblies of the wall modules, it is generally preferable that as many modules as possible be of a standardized construction so as to minimize cost. It will be noted that the structure 100 may be constructed from a plurality of panel modules, only one of which—a door module—is non-standardized. The same is true of any m×n module structure, where m and n are integers, which is constructed similarly to structure 100 with no overlap at two corners of the structure. With respect to structure 200, or any other m×n module structure similarly constructed with overlap at all corners, only three non-standardized panel modules are required—a door module and two modules having the alternative embodiment of module 220. In both types of m×n module structures the lengths of the ceiling modules (and the heights of the wall modules, too, if a set of standardized modules is being used) essentially satisfy the equation $$L = \sum_{i=1}^{n} W_i + 2d + T_s,$$

where L is the length of the frame assembly, $W_i$ is the width of the frame assembly of the i th module along the side of the structure having n modules, d is the depth of the framing portion of the modules, and $T_s$ is the sum of any additional materials, such as padding 112, inserted between modules. For structure 100, if no padding 112 is inserted between modules at the two rear corners to minimize light and dust leakage and the modules have frame assemblies of a standardized height and width, the equation becomes $L=(n\times W_s)+2d$, where $W_s$ is the standardized width of the frame assemblies of the modules. For structure 200, which uses two modules of the alternative embodiment 220 and requires no padding for minimizing lightproofing or dustproofing, the equation becomes $L=(n-1)W_s+W_a+2d$, where $W_s$ is the width of the frame assemblies of the standardized modules and $W_a$ is the width of the frame assemblies of the alternative embodiment. As previously disclosed, it is preferable that the frame assembly 222 of module 220 be less wide than the frame assembly 22 of module 20, and, because the widths of the overhangs of module 20 are preferably selected to be less than the width of the framing portions of the frame assembly, $W_a$ is preferably selected to satisfy the equation $W_s \geqq W_a \geqq W_s - w$, where w is the width of the framing portions of the frame assemblies. For such a $W_a$, the length equation becomes $(n\times W_s)-w+2d \leqq L \leqq (n\times W_s)+2d$, and it is preferable not only that the lengths of the frame assemblies of the ceiling modules fall within this range and be essentially identical to one another, but also that the heights of the frame assemblies of all the other modules employed in an m×n module structure such as structure 200 be essentially identical to the lengths of the frame assemblies of the ceiling modules.

Thus, for the 4×3 module structure 100, with no padding such as padding 112 being employed, if the width of the frame assembly 22 is selected to be 2' and 1"×2" framing portions having a width of $\frac{3}{4}$" and a depth of $1\frac{1}{2}$" are employed, the height of each module would be approximately 6'3". For the 4×3 module structure 200, the length of the frame assembly of each module would preferably be chosen to fall in the range 6'$2\frac{1}{4}$" to 6'3", depending upon the value of $W_a$, which would preferably be in the range 1'$11\frac{1}{4}$" to 2'. Consequently, it may be seen that it is possible to predetermine for any m×n module ceilinged enclosure the dimensions of the modules to be employed in constructing the enclosure and to provide a kit form the necessary modules for constructing an enclosure of a given size. It will be recognized, however, as previously explained, that the overall height of the enclosure may be varied slightly depending upon the size of the base members, such as members 106, 108, and 109, employed. It should also be recognized that the overall outside dimensions of the structures 100 and 200 will be affected to some slight degree by the thickness of the sheathing material employed.

Thus there have been shown and described several embodiments of a novel prefabricated panel module construction which fulfill all of the objects and advantages sought therefor. It is apparent, however, as indicated, that many changes, modifications, variations, and other uses and applications of the subject panel module construction are possible and will become apparent to those skilled in the art after considering this specification, which has described preferred embodiments only. All such changes, modifications, variations, and other uses and applications which do not depart from the spirit and scope of the invention are deemed to be covered by the invention which is limited only by the claims which follow.

What is claimed is:

1. A single-walled prefabricated panel module interconnectable with other panel modules in side-to-side right angular relationships without intermediate structural elements for use in constructing interior walls and enclosures comprising a substantially rectangular frame assembly, said frame assembly including oppositely disposed substantially similar third and fourth side framing portions positioned transverse to and connecting said first and second side frame portions, all of said framing portions having a rectangular cross-section and front, rear, and outer side surfaces, a substantially flat sheet of sheathing material having side edges defining a substantially rectangular shape attached to said frame assembly, each of said framing portions having a respective side edge of said sheathing material associated therewith, said sheathing material being so attached to said frame assembly to engage the front surface of each framing portion and to at least partially overlap the front surface of said first framing portion along its length, said sheathing material projecting beyond outer side surfaces of the remaining framing portions of said frame assembly to form overhangs therealong, said overhangs projecting beyond said frame assembly a distance less than the width of said first framing portion and less than the depth of said third framing portion, said subject panel module adapted to be interconnectable with a like module wherein the rear surface of said first framing portion of said subject panel module is placed in abutment with the outer side surface of the second framing portion of a like module and the overhang associated with the second framing portion of the like module abuts and at least partially overlaps said outer side surface of said first framing portion of said subject panel module along the length of said first framing portion, and means for connecting said first framing portion of said subject panel module to the second framing portion of a like module.

2. The panel module of claim 1 wherein said first framing portion projects beyond the associated edge of said sheathing material to form an underhanging therealong, the width of said underhanding being less than the width of said first framing portion and at least as great as the width of said overhang oppositely disposed therefrom.

3. The panel module of claim 1 wherein said sheathing material projects beyond said first framing portion to form an overhang therealong.

4. The panel module of claim 3 wherein the widths of all of said overhangs are substantially equal to one another.

5. The panel module of claim 3 wherein all of said framing portions have substantially identical crosssectional dimensions.

6. A standardized single-walled panel module simultaneously interconnectable with other panel modules in side-by-side planar and side-to-side right angular relationships without intermediate structural elements for use in constructing interior walls and enclosures comprising a substantially rectangular frame assembly, said frame assembly including first, second, third, and fourth side framing portions of substantially uniform rectangular cross-sectional dimensions, each of which framing portions has front, rear, and outer side surfaces, substantially flat sheathing material having side edges defining a substantially rectangular shape attached to the framing portions of said frame assembly, each of said framing portions having a side edge of said sheathing material associated therewith, said sheathing material being so attached to said frame assembly to engage the front surface of each framing portion, to project beyond said second, third and fourth framing portions of said frame assembly to form overhangs therealong, and to partially overlap said first side framing portion along its length, said first side framing portion projecting beyond the associated edge of said sheathing material to form an underhanging therealong, the width of said underhanding being less than the width of said framing portions, said overhang oppositely disposed from said underhanging projecting beyond said frame assembly a distance less than the width of the underhanging, the width of the overhangs at the remaining sides of the frame assembly being less than the depth of the framing portions, said subject panel module adapted to be simultaneously interconnectable with a first like module wherein the rear surface of said first side framing portion of said subject panel module is placed in abutment with the outer side surface of the second side framing portion of the first like module and the overhang associated with the second side framing portion of the first like module abuts and at least partially overlaps said outer side surface of said first side framing portion of said subject panel module along the length of said first side framing portion and with a second like module wherein the outer surface of said second side framing portion of said subject panel module is placed in abutment with the outer side surface of the first side framing portion of the second like module and the overhang associated with the second side framing portion of said subject panel module abuts and at least partially overlaps the front surface of the first side framing portion of the second like panel module along the length thereof.

7. The panel module of claim 6 wherein said rectangular frame assembly has two longer sides and two shorter sides and said underhanging is associated with one of the longer sides of said rectangular frame assembly.

8. The panel module of claim 8 wherein a cross-brace framing member extends between the two shorter sides of the rectangular frame assembly at an intermediate position between the two longer sides thereof and said sheathing material is lightproof.

9. The panel module of claim 6 including means for attaching said panel module to like panel modules.

10. The panel module of claim 9 wherein said framing portions have holes therein and said attachment means include threaded fastener means adapted to pass through said holes in adjacent modules.

11. A standardized panel module interconnectable with other panel modules in right angular relationships without intermediate structural elements for use in constructing walls and enclosures comprising a rectangular frame assembly having oppositely disposed substantially identical first and second side framing portions and oppositely disposed substantially identical end framing portions transverse to said side framing portions; all of said framing portions having definable side surface portions; paneling means of substantially rectangular shape, the height of said paneling means being slightly greater than the height of said frame assembly; the width of said paneling means being no greater than the width of said frame assembly; said paneling means being attached to said frame assembly to overlap and overhang each of said end framing portions to define end overhangs therealong, to overlap and overhang said first side framing portion to define a side overhang therealong, and to partially overlap said second side framing portion along the entire length of said framing portion to effect a lap joint therewith and to define a rabbet therealong; the width of said rabbet being less than the width of said side framing portions, said side overhang having a width less than the width of said rabbet, and side end overhangs having a width less than the depth of said end framing portions; the length of said frame assembly essentially satisfying the equation $(n \times W) - w + 2d \leqq L \leqq (n \times W) + 2d$, where L is the length of said frame assembly, w is the width of said frame assembly, n is a positive integer, w is the width of said framing portions, and d is the depth of said framing portions, said subject panel module being adapted to be interconnectable to a like module in a right angular relationship therewith with one of said framing portions of the subject panel module that has an overhand associated therewith abutting one of the framing portions of the like module and with the overhang associated with the one framing portion of the subject panel module engaging and at least partially overlapping the side surface portion of the one framing portion of the like module.

12. The panel module of claim 11 wherein the width of said side overhang is less than the depth of said side framing portions.

13. The panel module of claim 11 wherein the depth of said side framing portions is substantially identical to the depth of said end framing portions.

14. Means for constructing essentially lightproof and dustproof wall and corner modular assemblies from panel modules adapted to be interconnectable to one another in both side-by-side planar and side-to-side right angular relationships without intermediate structural elements comprising a first panel module of lightproof material having a rectangular shape with first and second end portions and with reciprocally rabbetted first and second side edge portions, said first side edge portion being rabbetted to form a one-sided tenon with an obverse rabbet and said second side edge portion being rabbetted to form a one-sided tenon with a reverse rabbet, a second panel module substantially identical to said first panel module, and means for attaching said second panel module to said first panel module to join and rigidly hold said panel modules together to form essentially lightproof and dustproof joints therebetween when such modules are in a side-by-side planar relationship with one-sided tonons along the second side edge portion of said first panel module and the first side edge portion of said second panel module forming a scarfjoint and also when such modules are in a side-to-side right angular relationship with the one-sided tonons along the second side edge portion of said first panel module and the first side edge portion of said second panel module forming a corner edge lap joint wherein the one-sided tenon along the first side edge of said second panel module is engaged with said reverse rabbet of said first panel module.

15. The means defined in claim 14 wherein said first and second end portions are similarly rabbetted to form one-sided tenons with reverse rabbetts.

16. Means for constructing wall and corner segments from panel modules adapted to be interconnectable to one another in both side-by-side planar and side-to-side right angular relationships without intermediate structural elements comprising a first panel module having a rectangular shape with reciprocally rabbetted first and second side edge portions, said first side edge portion being rabbetted to form a one-sided tenon with an obverse rabbet, said second side edge portion being rabbetted to form a one-sided tenon with a reverse rabbet, said first panel module having ceiling and base end edge portions, said base end edge portion being rabbetted to form a one-sided base tenon with a reverse rabbet, said ceiling end edge portion being similarly rabbetted to form a one-sided ceiling tenon with a reverse rabbet, a second panel module substantially identical to said first panel module, base means, and attachment means to join and rigidly hold said panel modules together with such modules are in a side-by-side planar relationship with the one-sided tenons of the second side edge portion of said first panel module and of the first side edge portion of said second panel module forming a scarf joint and also when such modules are in a side-to-side right angular relationship with the one-sided tenons of the second side edge portion of said first panel module and the first side edge portion of said second panel module forming a corner edge lap joint wherein the one-sided tenon along the first side edge of said second panel module is engaged with said reverse rabbet of said first panel module, said attachment means including means to join and hold the joined panel modules and said base means in rigid attachment with said base tenon of each of said panel modules overlapping said base means to form a lap joint therewith.

17. The means defined in claim 16 including ceiling means and means for attaching the joined panel modules to said ceiling means with said ceiling tenon of each of said panel modules overlapping said ceiling means to form a lap joint therewith.

18. Means for constructing a wall corner from panel modules interconnectable with one another in a side-to-side right angular relationship without intermediate structural elements comprising a first panel module having a rectangular shape with reciprocally rabbetted side edge portions, one side edge portion being rabbetted to form a one-sided obverse tenon with a reverse rabbet, the other side edge portion being rabbetted to form a one-sided reverse tenon with an obverse rabbet, said reverse tenon having a definable side surface portion, a second panel module substantially identical to said first panel module, means for attaching said second panel module to said first panel module to join the hold said panel modules in a side-to-side right angular relationship with said obverse tenon of said first panel module overlapping said side surface portion of said reverse tenon of said second panel module.

19. The means defined in claim 18 wherein each of said panel modules has similarly rabbetted base and ceiling end portions, each said end portions being rabbetted to form a one-sided obverse tenon with a reverse rabbet.

20. The means defined in claim 19 including base corner means and means for attaching said panel modules when joined to one another to said base corner means to hold said panel modules in rigid attachment thereto with said base tenon of each of said panel modules overlapping said base corner means to form a lap joint therewith.

21. The means defined in claim 20 including ceiling means and means for attaching said ceiling means to said joined panel modules with said ceiling tenon of each of said panel modules overlapping said ceiling means to form a lap joint therewith.

22. A standardized panel module interconnectable with other panel modules in side-by-side planar, side-to-side right angular, end-to-end right angular, and side-to-end right angular relationships without intermediate structural elements for use with one or more other panel modules and a base member in constructing walls and enclosures comprising a rectangular frame assembly having oppositely disposed first and second side framing portions and oppositely disposed end framing portions transverse to said side framing portions; each of said framing portions having a definable outer side surface portion; paneling means of substantially rectangular shape; the heighth of said paneling means being slightly greater than the heighth of said frame assembly; the width of said paneling means being no greater than the width of said frame assembly; said paneling means being attached to said frame assembly to overlap and overhang each said end framing portion to define an end overhang therealong, to overlap and overhang said first side framing portion to define a side overhang therealong, and to partially overlap said second side framing portion along the entire length of said side framing portion to effect a lap joint therewith and to define a rabbet therealong; said side overhang adapted to be reciprocally engageable with the rabbet of a like panel module to therewith effect a rabbet joint when the like module is in side-by-side juxtaposed relationship with said subject panel module and to be capable of at least partially overlapping the outer side surface portion of the side framing portion of a like panel module to effect a lap joint therewith when the like panel module is in a side-to-side right angular relationship with said subject panel module; one end overhang adapted to be capable of at least partially overlapping the outer side surface portion of the end framing portion of a like panel module to effect a lap joint therewith when the like panel module is in an end-to-end right angular relationship with said subject panel module and to be capable of at least partially overlapping the outer side surface portion of the side framing portion of a like panel module to effect a lap joint therewith when the like panel module is placed in a side-to-end right angular relationship with said subject panel module; the other end overhang adapted to be capable of at least partially overlapping a base member to effect a lap joint therewith when the base member abuts the outer side surface portion of the framing portion associated with said end overhang of the subject panel module.

23. The panel module of claim 22 including attachment means wherein said framing portions have holes therein and said attachment means include threaded fastener means adapted to cooperate with said holes.

24. A kit for constructing a room-like enclosure from panel modules interconnectable with one another in right angular and side-by-side planar relationships without intermediate structural elements comprising one or more ceiling panel modules, each of which is substantially identical to each other ceiling module, a door module, a plurality of substantially identical wall panel modules, said door module having a rectangular shell portion frame assembly and a door portion attached to said shell portion frame assembly, each of said ceiling and wall panel modules including a substantially rectangular panel frame assembly and substantially flat sheathing material having side edges defining a substantially rectangular shape attached to said frame assembly, said panel frame assemblies each including four side framing portions of substantially rectangular cross-sectional dimensions, each of said framing portions having a respective side edge of said sheathing material associated therewith, said sheathing material being so attached to said frame assembly to project beyond three side framing portions of said panel frame assembly to form overhangs therealong and to partially overlap the fourth side framing portion along its length, said last named framing portion projecting beyond the associated edge of said sheating material to form an underhanging therealong, the width of said underhanging being less than the width of said framing portions, said overhang oppositely disposed from said underhanging projecting beyond said panel frame assembly a distance less than the width of the underhanging, the width of the overhangs at the remaining sides of the panel frame assembly being less than the depth of the framing portions, a substantially rectangular base portion including a plurality of base members of substantially identical cross-sectional dimensions, and attachment means for attaching said door module and said wall panel modules to said base portion, for directly attaching adjacent framing portions of said door module and said wall panel modules to one another when said door module and said wall modules are positioned on said base portion to define walls and corners, for directly attaching adjacent framing portions of said ceiling modules to one another when said ceiling modules are positioned in side-by-side juxtaposition to define a ceiling, and for directly attaching adjacent framing portions to said ceiling modules and said door module and wall modules to one another when said ceiling modules are positioned adjacent to said door module and wall modules in right angular relationship thereto.

25. The kit defined in claim 24 wherein the widths of said panel frame assemblies and said shell portion frame assembly are all substantially identical.

26. The kit defined in claim 25 wherein the length of each said panel frame assembly of each said ceiling panel module essentially satisfies the equation $L=(n\times W)+2d$, where L is the length of said ceiling module panel frame assembly, n is a positive integer, W is the width of said frame assemblies, and d is the depth of said framing portions.

27. The kit defined in claim 24 wherein said ceiling modules and said wall modules are substantially identical.

28. A kit for constructing a room-like enclosure from panel modules interconnectable with one another in right angular and side-by-side relationships without intermediate structural elements comprising one or more ceiling panel modules, each of which is substantially identical to each other ceiling module, a door module, and a plurality of wall panel modules, said plurality of wall panel modules including a plurality of substantially identical standardized modules and two substantially identical non-standardized modules, said door module having a rectangular shell portion frame assembly and a door portion attached to said shell portion frame assembly, each of said ceiling and wall panel modules including a substantially rectangular panel frame assembly and substantially flat sheathing material having side edges defining a substantially rectangular shape attached to said panel frame assembly, said panel frame assemblies each having oppositely disposed first and second side framing portions and oppositely disposed third and fourth side framing portions positioned transverse to and connecting said first and second side framing portions, all said side framing portions having substantially rectangular cross-sectional dimensions, each of said framing portions having a respective side edge of said sheathing material associated therewith, said sheathing material being so attached to said frame assembly to at least partially overlap said first framing portion along its length and to project beyond the remaining side framing portions of said frame assembly to form overhangs therealong, said overhangs projecting beyond said frame assembly a distance less than the width of said framing portions, said sheathing material of said non-standardized modules projecting beyond said first framing portion thereof to form an additional overhang therealong, the width of said additional overhang being substantially equal to the width of said overhang oppositely disposed therefrom, said first framing portions of each of said ceiling and standardized wall modules projecting beyond the associated edges of said sheathing materials thereof to form underhangings, the width of each said underhanging being less than the width of said framing portions and greater than the width of said overhang oppositely disposed therefrom, a substantially rectangular base portion including a plurality of base members of substantially identical cross-sectional dimensions, and attachment means for attaching said door module and said wall panel modules to said base portion, for directly attaching adjacent framing portions of said door module and said wall panel modules to one another when said door module and said wall modules are positioned on said base portion to define walls and corners, for directly attaching adjacent framing portions of said ceiling modules to one another when said ceiling modules are positioned in side-by-side juxtaposition to define a ceiling, and for directly attaching adjacent framing portions of said ceiling modules and said door module and wall modules to one another when said ceiling modules are positioned adjacent to said door module and wall modules in right angular relationship thereto.

29. The kit defined in claim 28 wherein the framing portions of said panel modules all have substantially identical cross-sectional dimensions.

30. The kit defined in claim 29 wherein the widths of the shell portion frame assembly of said door module and of the panel frame assemblies of said standardized modules are all substantially equal.

31. The kit defined in claim 30 wherein the width of the panel frame assemblies of said non-standardized wall modules essentially satisfies the equation $W_s \geqq W_a \geqq W_s - w$, where $W_a$ is the width of the panel frame assemblies of said non-standardized wall modules, $W_s$ is the width of the panel frame assemblies of said standardized wall modules, and w is the width of said framing portions.

32. The kit defined in claim 31 wherein the length of the panel frame assembly of each ceiling panel module essentially satisfies the equation $(n \times W_s) + 2d \geqq L \geqq (n-1)W_s - w + 2d$, where L is the length of said ceiling module panel frame assembly, d is the depth of said framing portions, and n is an integer.

33. The kit defined in claim 32 wherein said ceiling modules and said standardized wall modules are all substantially identical.

34. The kit defined in claim 33 wherein the height of the panel frame assemblies of said non-standardized modules is essentially equal to the length of the panel frame assemblies of said ceiling panel modules.

* * * * *

UNITED STATES PATENT AND TRADEMARK OFFICE

CERTIFICATE OF CORRECTION

PATENT NO. : 4,228,626

DATED : October 21, 1980

INVENTOR(S) : Stanley F. Trampe

It is certified that error appears in the above—identified patent and that said Letters Patent is hereby corrected as shown below:

Column 1, line 7, of the Abstract, "tion" should read -- tional --.

Column 17, line 29, "sheating" should read -- sheathing --.

Signed and Sealed this

*Twentieth* Day of *January 1981*

[SEAL]

*Attest:*

RENE D. TEGTMEYER

*Attesting Officer*

*Acting Commissioner of Patents and Trademarks*